US005138135A

United States Patent [19]

Husslein et al.

[11] Patent Number: 5,138,135

[45] Date of Patent: Aug. 11, 1992

[54] COOKTOP

[75] Inventors: Julius Husslein, Vachendorf; Heinrich Detterbeck, Traunreut, both of Fed. Rep. of Germany

[73] Assignee: Bosch-Siemens Hausgeräte GmbH, Munich, Fed. Rep. of Germany

[21] Appl. No.: 647,711

[22] Filed: Jan. 28, 1991

[30] Foreign Application Priority Data

Jan. 26, 1990 [DE] Fed. Rep. of Germany ..... 4002322

[51] Int. Cl.[5] ..... H05B 3/74

[52] U.S. Cl. ..... 219/464; 219/506

[58] Field of Search ..... 219/464, 465, 453, 506

[56] References Cited

U.S. PATENT DOCUMENTS

| | | | |
|---|---|---|---|
| 2,346,237 | 4/1944 | Rutenber | 219/453 |
| 2,492,100 | 12/1949 | Kitson | 219/453 |
| 2,870,316 | 1/1959 | Ferguson | 219/453 |
| 4,794,233 | 12/1988 | Goessler | 219/464 |
| 5,004,892 | 4/1991 | Goessler | 219/464 |
| 5,013,893 | 5/1991 | Goessler | 219/453 |

FOREIGN PATENT DOCUMENTS

| | | | |
|---|---|---|---|
| 1346574 | 2/1974 | United Kingdom | 219/464 |

*Primary Examiner*—Teresa J. Walberg

*Attorney, Agent, or Firm*—Herbert L. Lerner; Laurence A. Greenberg

[57] ABSTRACT

A cooktop includes an at least partially transparent surface being formed of glass or glass ceramic and having burner regions with peripheral and inner portions. Heating elements are disposed beneath the surface in the vicinity of the burner regions. A lighting apparatus visually indicates heating of the surface exceeding a predetermined temperature at which the surface is permitted to be touched. The lighting apparatus has a temperature-dependent switch thermally coupled to the surface and light devices controlled by the switch. Each of the light devices is disposed in one of the portions of a respective one of the burner regions.

8 Claims, 9 Drawing Sheets

COOKTOP

The invention relates to a cooktop having an at least partially transparent surface formed of glass or glass ceramic, heating elements disposed beneath the surface in the vicinity of burner regions of the surface, a lighting apparatus for visually indicating heating of the surface exceeding a predetermined temperature at which the surface is permitted to be touched through the use of a temperature-dependent switch thermally coupled to the surface, and a light device controlled by the switch.

In known cooktops, such as those described in German Patent DE-PS 29 51 410, a so-called residual-heat indicator device is provided in the form of a temperature-dependent switch that serves to control a light or signal device.

It is accordingly an object of the invention to provide a cooktop, which overcomes the hereinafore-mentioned disadvantages of the heretofore-known devices of this general type, which improves the recognizability and orientation of the light devices with respect to the various burner regions on the surface, and which improve the structure of the entire lighting apparatus.

With the foregoing and other objects in view there is provided, in accordance with the invention, a cooktop, comprising an at least partially transparent surface being formed of glass or glass ceramic and having burner regions with peripheral and inner portions, heating elements disposed beneath the surface in the vicinity of the burner regions, and a lighting apparatus for visually indicating heating of the surface exceeding a predetermined temperature at which the surface is permitted to be touched, the lighting apparatus having a temperature-dependent switch thermally coupled to the surface and light devices controlled by the switch, each of the light devices being disposed in one of the portions of a respective one of the burner regions.

Optimal recognizability and optimal orientation of the light device with respect to the burner are attained by geometrically incorporating the light device with the associated burner region. At the same time, the associated burner region is visually identified by the light device, and the exact placement of the cooking pot on the burner region is facilitated.

In accordance with another feature of the invention, the identification and exact placement is especially easy if the light device is disposed on the periphery of the burner region, for instance in the form of a luminous line or a succession of luminous dots disposed on a circumferential line.

In accordance with a further feature of the invention, the light device is constructed as an elongated fiber optical wave guide, which is optically connected to a single light source.

In accordance with an added feature of the invention, instead of a fiber optical wave guide, other light devices may be provided, such as incandescent or fluorescent bulbs, which are connected to a single source of electrical power.

In accordance with an additional feature of the invention, the safety temperature limiter component already provided in such a cooktop, for instance a glass-ceramic cooktop, is used in this case as an electrical connection element, by simply providing this component with an additional electric contact pair, or by having it serve as a carrier for a light source for the fiber optical wave guide.

In accordance with a concomitant feature of the invention, the light device is structurally united with the temperature sensor of the aforementioned safety temperature limiter. The construction of the lighting apparatus for the so-called residual-heat indicator can be simplified in this way.

Other features which are considered as characteristic for the invention are set forth in the appended claims.

Although the invention is illustrated and described herein as embodied in a cooktop, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

Figure 21:
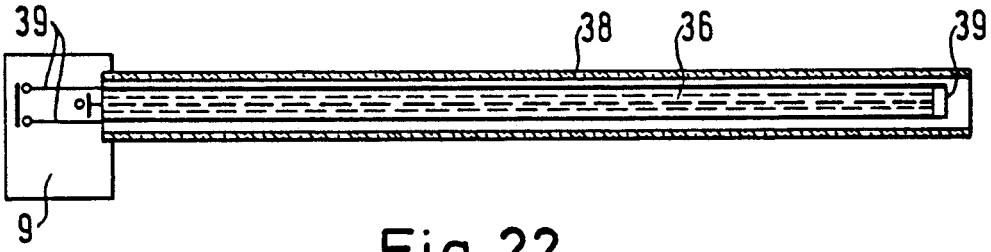
Figure 22:
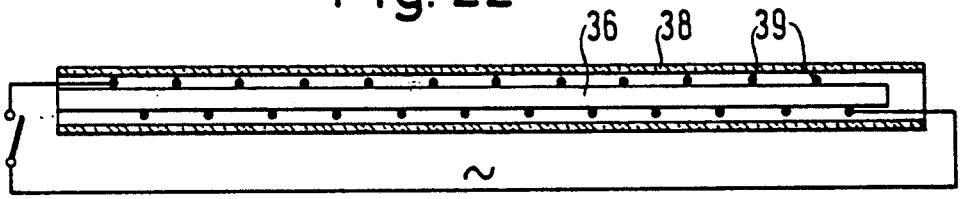
Figure 23:
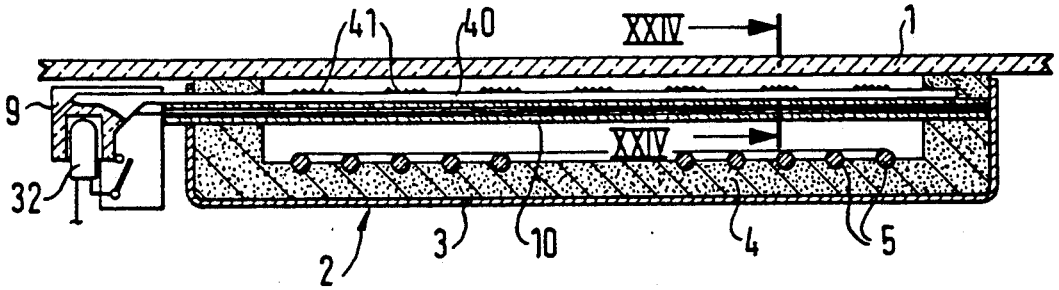
Figure 24:
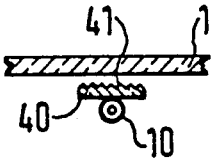

FIGS. 21 and 22 are various longitudinal-sectional views which differ in terms of the disposition of the light device in combination with the sensor of a safety temperature limiter; and FIGS. 23 and 24 are two different fragmentary, longitudinal-sectional views of an eighth embodiment of a glass-ceramic cooktop, using a fiber optical wave guide as the light device, wherein FIG. 24 is taken along the line XXIV—XXIV of FIG. 23, in the direction of the arrows.

Figure 1:
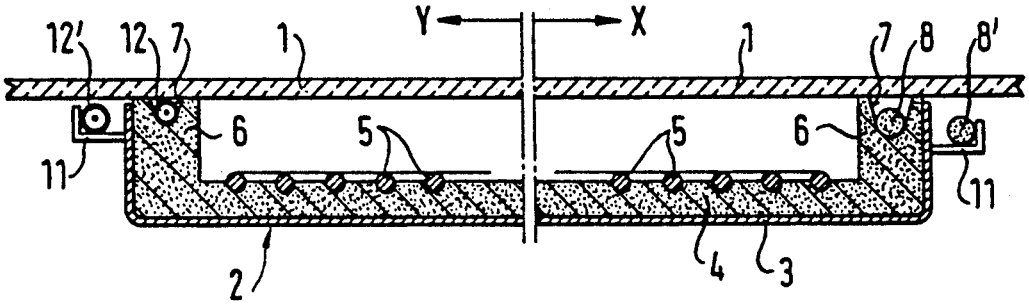
FIGS. 1 and 2 are respective fragmentary, diagrammatic, longitudinal-sectional and top-plan views of a first exemplary embodiment of a glass-ceramic cooktop.
Figure 2:
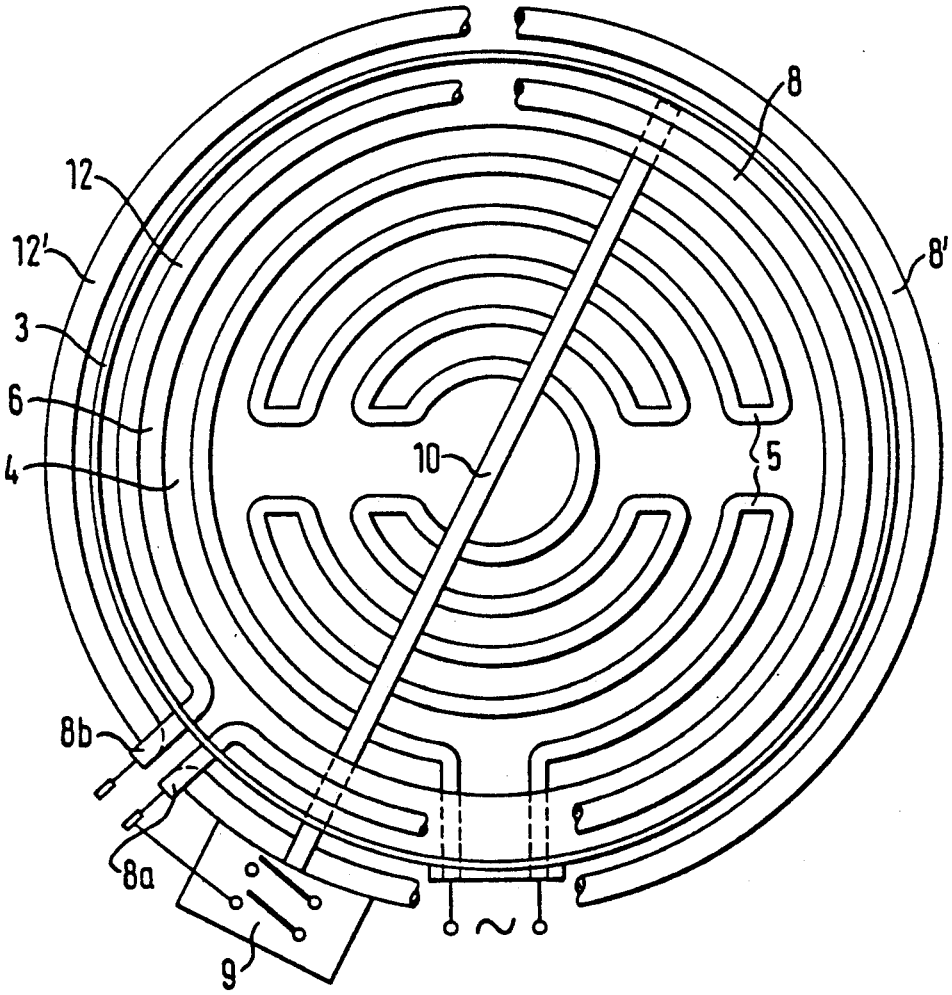
Figure 3:
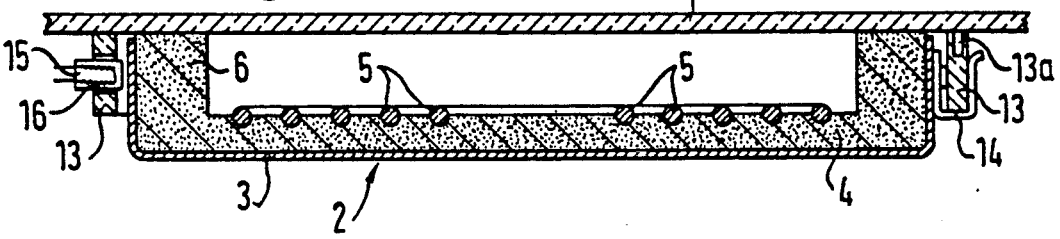
FIGS. 3 and 4 are respective fragmentary, longitudinal-sectional and top-plan views of a second exemplary embodiment of a glass-ceramic cooktop.
Figure 4:
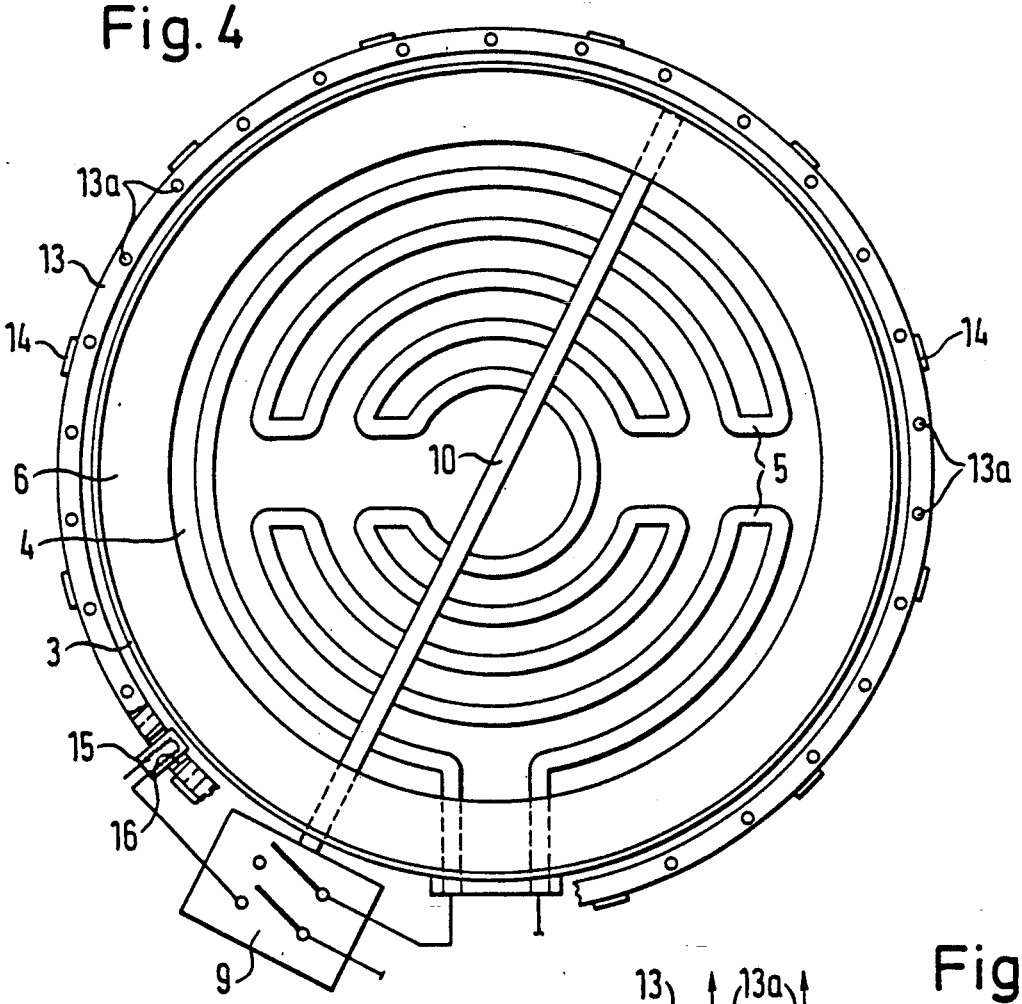

Referring now to the figures of the drawings in detail and first, particularly, to FIG. 1 thereof, there is seen a partly transparent surface or support 1 of glass-ceramic material on which cooking pots can be placed in order to heat them. An infrared radiation or radiant heating element 2, which is disposed under a cooktop burner region of the surface 1 and is identified by printing on the surface 1, is formed in a known manner of a cup-shaped metal jacket 3, thermal insulation carrier 4 disposed therein, and heating coils 5 supported by the insulation. The coils are connectable to an electric current network or mains supply, as shown in FIG. 2. As is indicated by arrows facing in opposite directions in FIG. 1, two different variants of this embodiment are shown on the left and right of the center plane in FIGS. 1 and 2, in terms of a lighting apparatus (residual-heat indicator) which is described below. In the exemplary embodiment seen in the direction X, a vertical, annularly encompassing wall 6 of the cup-shaped insulation carrier 4 has a likewise encompassing recess 7 machined therein which is open toward the surface 1, and an annular fluorescent bulb 8 representing the light device is disposed in this recess. The wall of the aforementioned recess forms a reflector for the light originating at the fluorescent bulb 8, which is projected in concentrated fashion toward the surface 1. FIG. 2 shows that the ends of these fluorescent bulbs are bent radially outward in the region of electrical connection locations 8*a* and 8*b* and are connected there to an electrical connection element, for instance to a known electrical safety temperature limiter 9, which is already provided in such glass-ceramic cooktops. The safety temperature limiter 9 has a switching part which is connected to a sheathed sensor 10 that may have an expansion bar. The sensor 10 extends radially across the radiant heating element 2 underneath the surface 1. To this end, the safety temperature limiter 9 is equipped with additional contacts. In addition to or as an alternative to the version just described above, the fluorescent bulb 8 may also be disposed outside the cup-shaped jacket 3. An external part 11 of the jacket 3 that is bent in the form of an L then serves as a support and reflector for the bulb 8. In the case of the variant shown in the direction Y, an incandescent bulb 12 having an incandescent coil or wire surrounded by a glass tube is provided as the light device instead of the fluorescent bulb 8. The bulb 12 is also annular in shape and likewise rests in the recess 7 in the insulation carrier 4. Once again, in addition or as an alternative, an incandescent bulb 12' of larger diameter may rest in the bent part 11 of the jacket 3. The annular light device serves as a so-called residual-heat indicator, in other words as a visual indicator that the heat of the surface 1 has exceeded the allowable temperature for being touched with the control of this light device being effected in a known manner by means of a temperature-dependent switch, for instance by means of a further track or path of the safety temperature limiter 9. However, in these exemplary embodiments, the annular light device not only serves as a residual-heat indicator, but it also furnishes a visual marking of the annular burner region of the cooktop.

Figure 5:
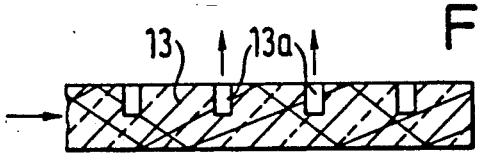
FIGS. 5, 6 and 7 are fragmentary, longitudinal-sectional views of various variants of a fiber optical wave guide used in the exemplary embodiment of FIGS. 3 and 4.
Figure 6:
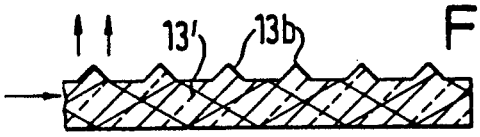
Figure 7:
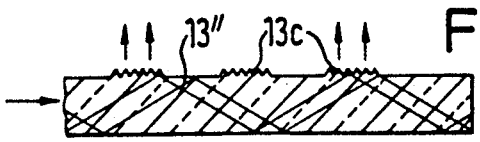

In the exemplary embodiment of FIGS. 3–7, an elongated, strip-like fiber optical wave guide 13 which likewise annularly outlines the burner region, is used instead of an incandescent or fluorescent bulb. The fiber optical wave guide 13 is located outside the jacket 3 of the radiant heating element 2 and is disposed in a pocket-like holder 14. This fiber optical wave guide 13 is optically coupled to a light source 15, which may be constructed as a low-voltage lamp, for instance, that protrudes into a recess 16 in the fiber optical wave guide. The light source 15 is in turn electrically connected to special contacts of the safety temperature limiter 9 (which may be a two-track temperature limiter), and is switched on when a predetermined temperature is reached. As FIGS. 5, 6 and 7 show, elements that form reflection surfaces are provided at equal intervals from one another in the course of fiber optical wave guides 13, 13', 13''. For instance, such elements forming reflection surfaces may be in the form of circular recesses 13*a*, saddle-like protrusions 13*b*, or ripples 13*c* in the fiber optical material. The light carried in the direction of the arrows in the fiber optical wave guide is reflected at these reflection surfaces in the direction of the surface 1 (as indicated by the arrows). At these locations, dot-shaped or dash-shaped fields of light, which provide readily visible luminous markings, are obtained in the course of the light device.

Figure 8:
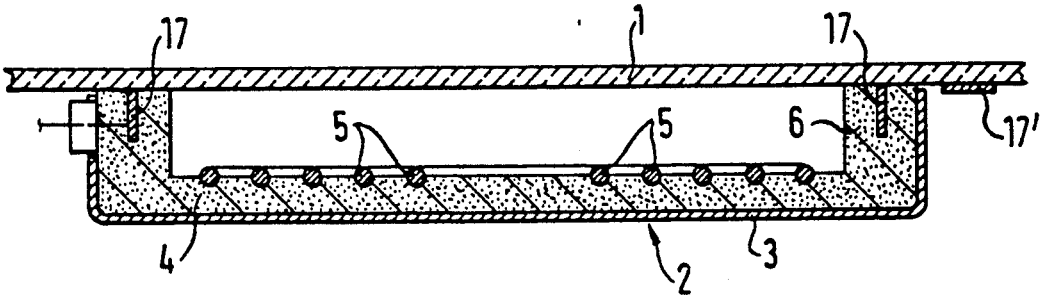
FIGS. 8 and 9 are views similar to FIGS. 1 and 2 of a third exemplary embodiment of a glass-ceramic cooktop having a fiber optical wave guide as a light device.
Figure 9:
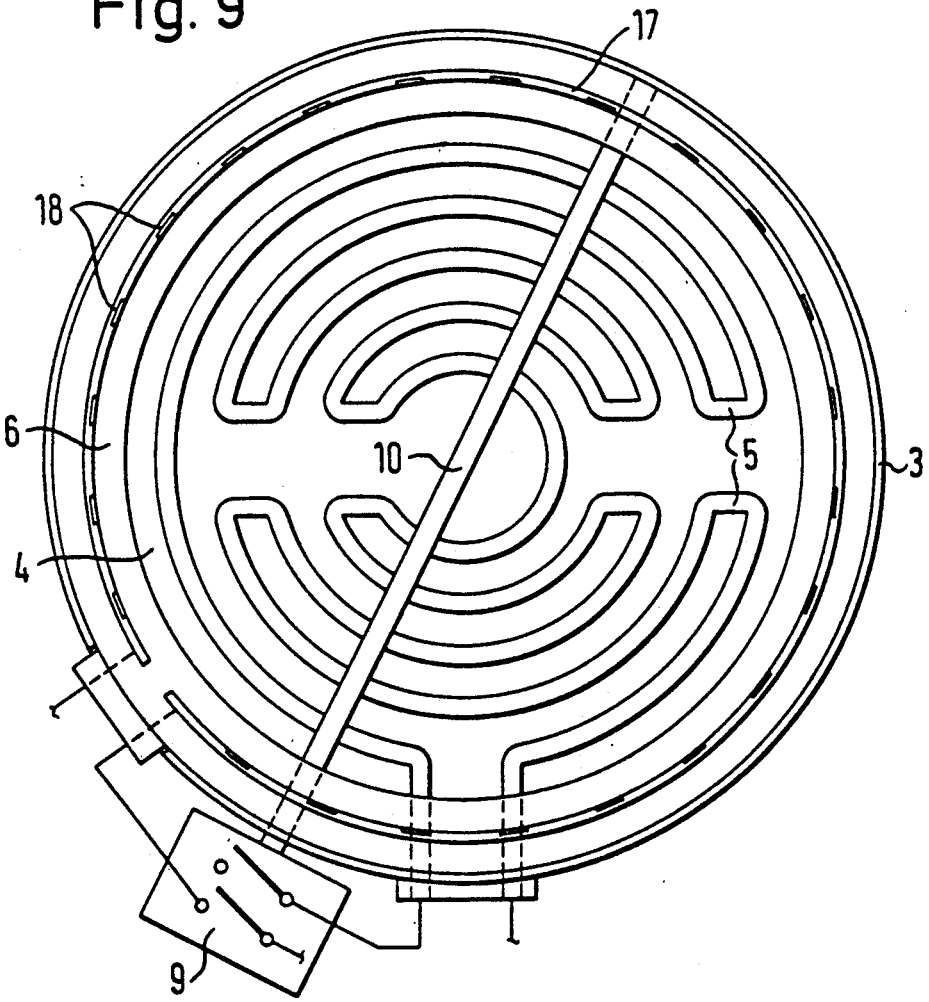
Figure 10:
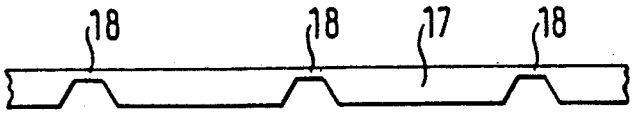
FIG. 10 is a fragmentary, elevational view of a portion of a fiber optical wave guide of FIGS. 8 and 9.

In the exemplary embodiment of FIGS. 8–10, an electrically conducting metal strip 17 is provided as the light device for the residual-heat indicator and for identifying the burner region of the surface 1. The metal strip 17 is embedded in the insulating material of the vertical wall 6 of the insulation carrier 4, flush with the end of the wall and with the partially transparent surface. Once again, the metal strip 17 is electrically connected to contacts of the safety temperature limiter 9. As FIG. 10 shows in particular, the metal strip has locations 18 of reduced cross section and increased electrical resistance, which succeed one another at uniform intervals. At these locations, incandescence and thus luminosity are effected upon application of electrical voltage. These cross-sectionally reduced locations 18 thus form dash-like luminous surfaces along the metal strip 17. As an alternative, a metal strip 17' of this type may also be applied to the underside of the glass-ceramic surface 1, for instance by printed on, as suggested in FIG. 8.

Figure 11:
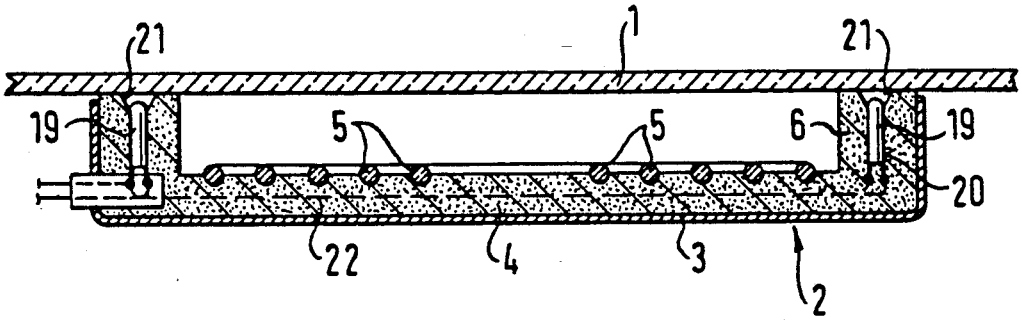
FIGS. 11 and 12 are other views similar to FIGS. 1 and 2 of a fourth exemplary embodiment of the glass-ceramic cooktop, using fluorescent bulbs.
Figure 12:
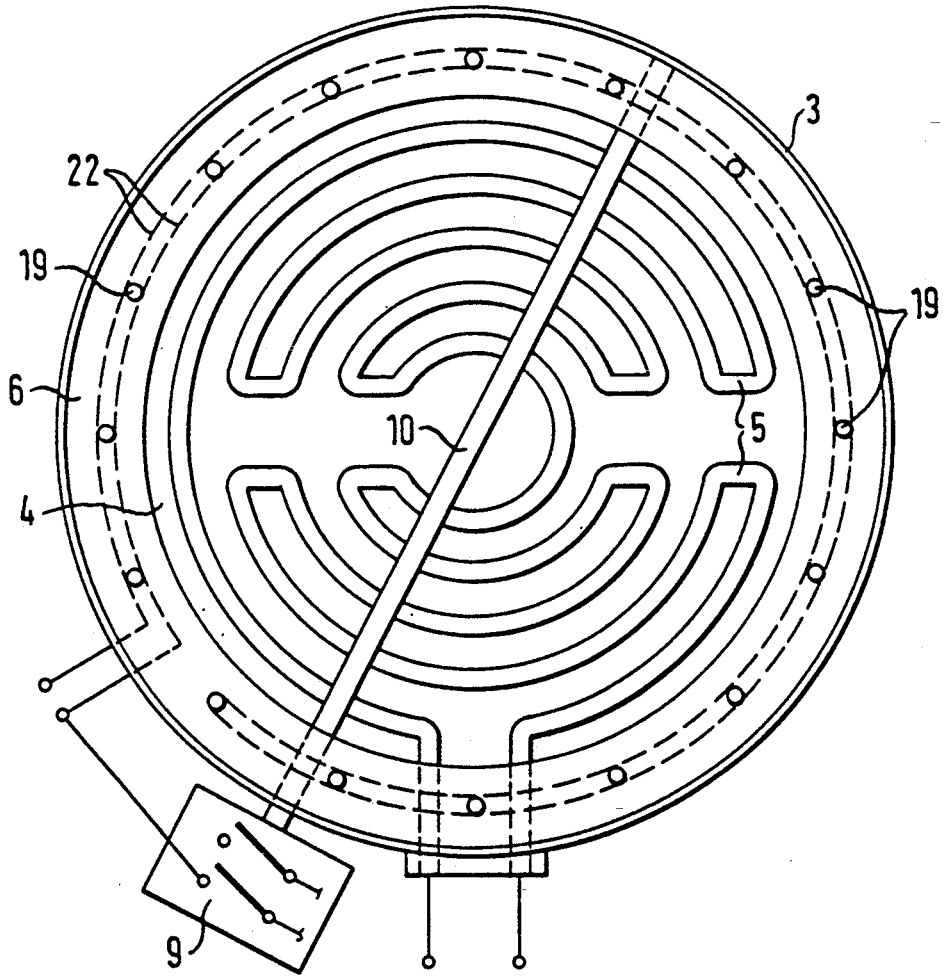

In the exemplary embodiment of FIGS. 11 and 12, a light device that once again annularly outlines the burner region of the surface 1 is formed by small fluorescent bulbs 19, which are embedded in corresponding hole-like recesses 20 in the insulation carrier 4 and protrude into the open in the region of upper, funnel-shaped recesses 21. These multiple small fluorescent bulbs 19 can again be connected to a current source, such as a current source of the safety temperature limiter 9. The bulbs 19 are connected in series with one another through electrical lines 22 extending in the insulation carrier 4.

Figure 13:
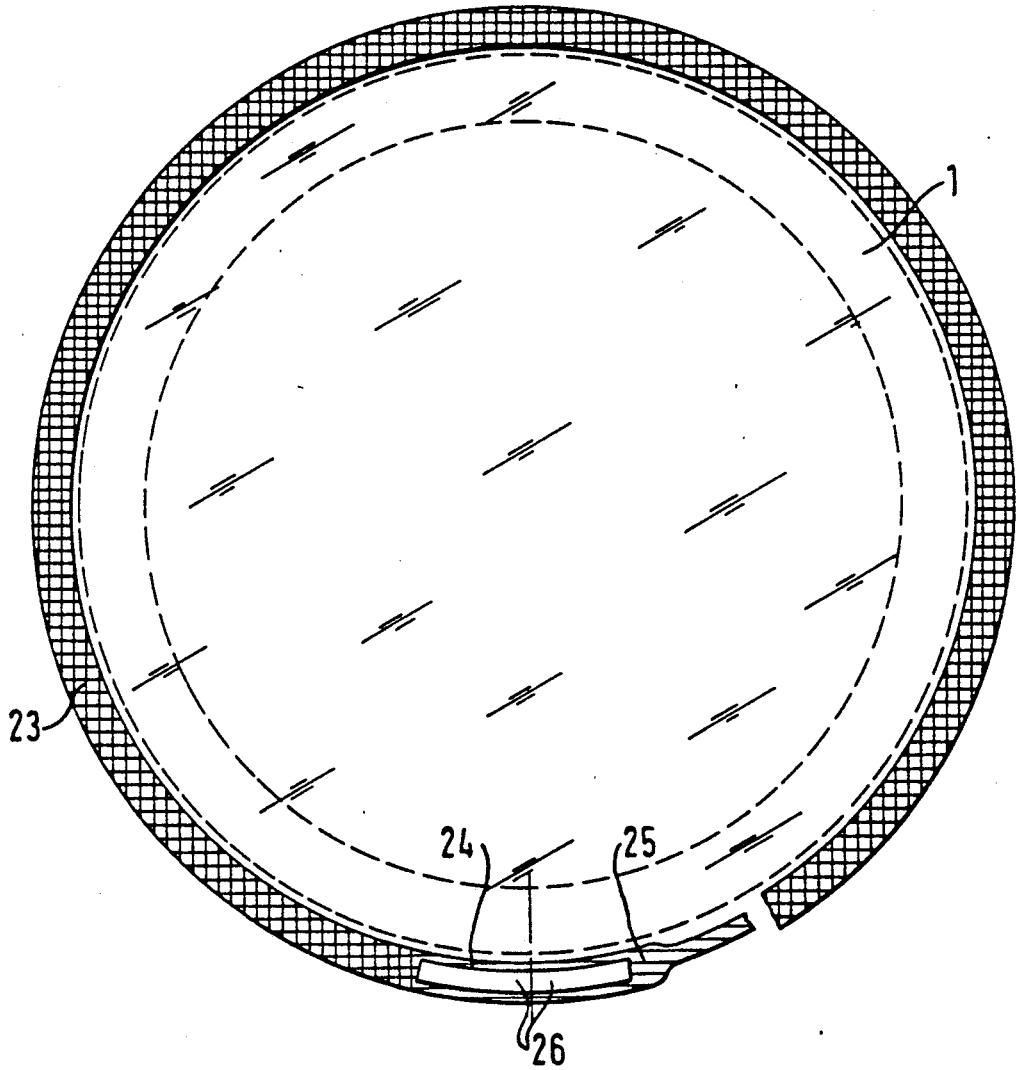
FIGS. 13 and 14 are respective top-plan and fragmentary views of an alternative version of a fifth exemplary embodiment of a cooktop.
Figure 14:
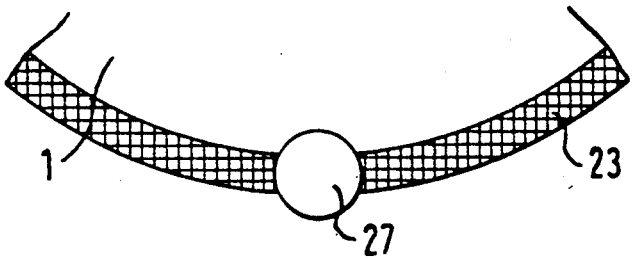

In the exemplary embodiment of FIGS. 13 and 14, the burner region of the heating surface of the cooktop of the glass-ceramic surface is outlined by an annular marking 23 printed on the surface 1. In a widened region 25, and/or in a region of continuous widths 24, this marking has an unprinted location 26, which is preferably oriented toward the front control panel of the cooktop. In the alternative of FIG. 14, the marking or position printing 23 is interrupted by an unprinted, circular area 27. Light devices with round or elongated shapes are again located under these locations 26 or 27, as described analogously above. This creates luminous surfaces that are incorporated with the position printing of the glass-ceramic plate 1.

Figure 15:
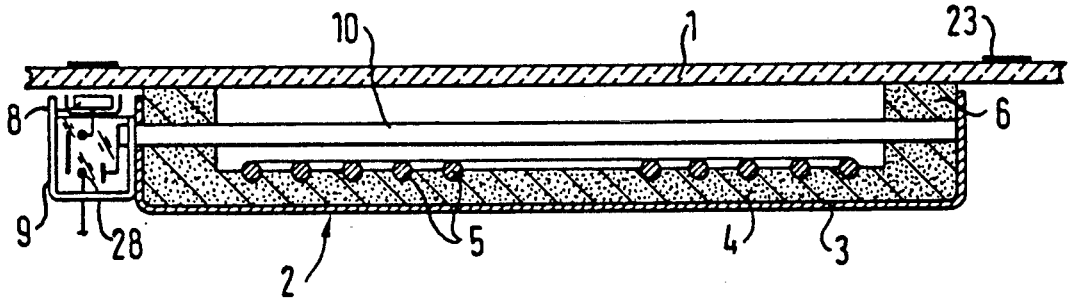
FIGS. 15 and 16 are further views similar to FIGS. 1 and 2 showing other details of the configuration of FIGS. 13 and/or 14.
Figure 16:
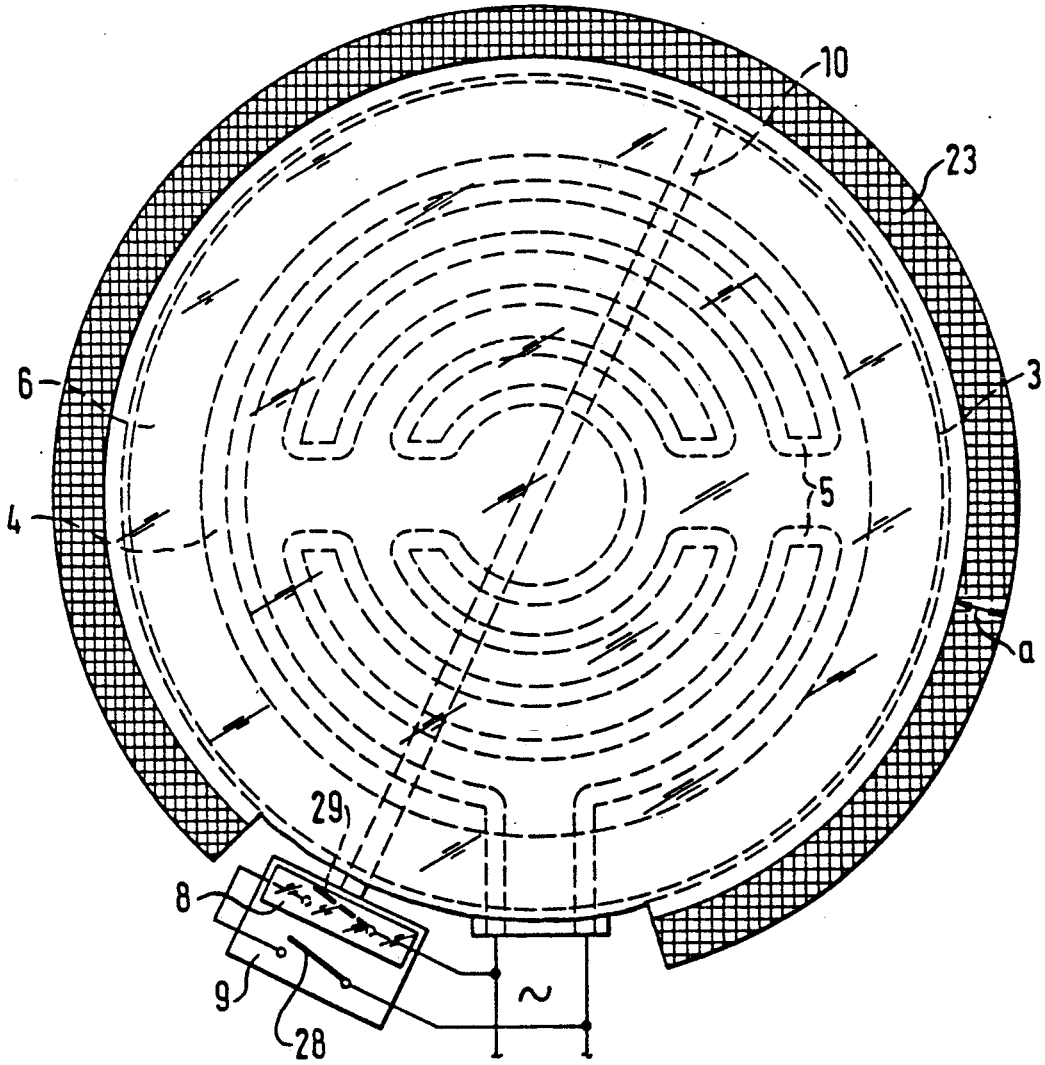

FIGS. 15 and 16 essentially show provisions of circuitry and disposition for the embodiment of FIGS. 13 and 14. These figures show that the light device, for example in the form of an elongated or round bulb, such as a fluorescent bulb, is incorporated mechanically and electrically with the safety temperature limiter 9, having the sensor 10 which again extends radially across the burner region. The light device, which may be identified by reference numeral 8 and may be in the form of a fluorescent bulb, is supported on the top of the safety temperature limiter component 9, for example with a reflector as its base, as FIG. 15 shows. In order to control the light device 8, the safety temperature limiter 9 has a contact 28 of a temperature-dependent switch or of a second control track of the safety temperature limiter, which is adjusted to meet the requirements for the "residual-heat indicator" function. A contact 29 associated with the "safety temperature limiter" function is indicated in the drawing in the vicinity of the light device 8. As already described in conjunction with FIGS. 13 and 14, the light device is incorporated in this case into the position marking 23, which has a width a.

Figure 17:
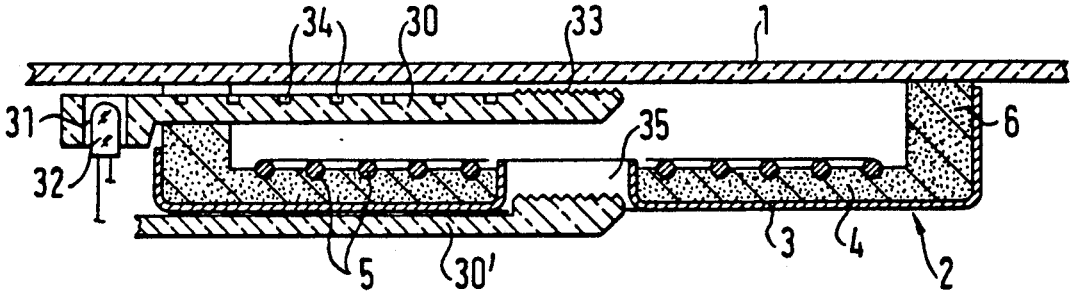
FIGS. 17 and 18 are additional views similar to FIGS. 1 and 2 of a sixth exemplary embodiment of a glass-ceramic cooktop, with a radially disposed fiber optical wave guide as the light device.
Figure 18:
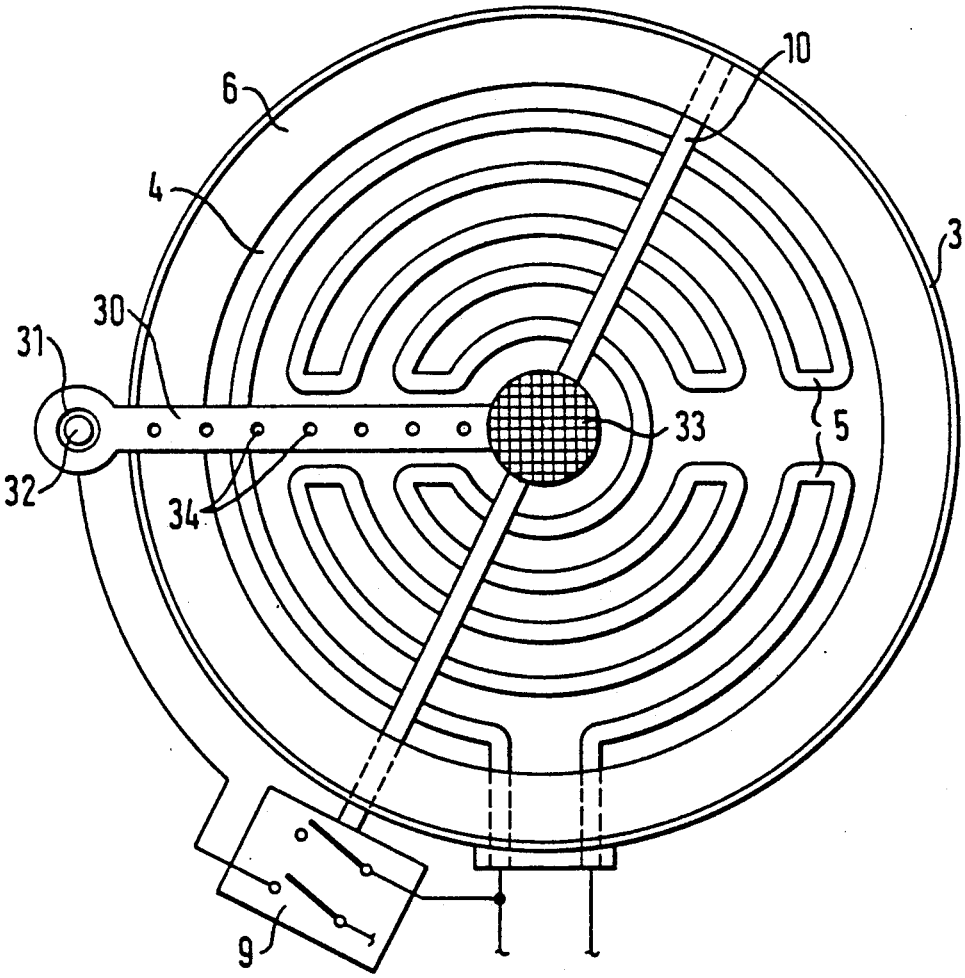
Figure 20:
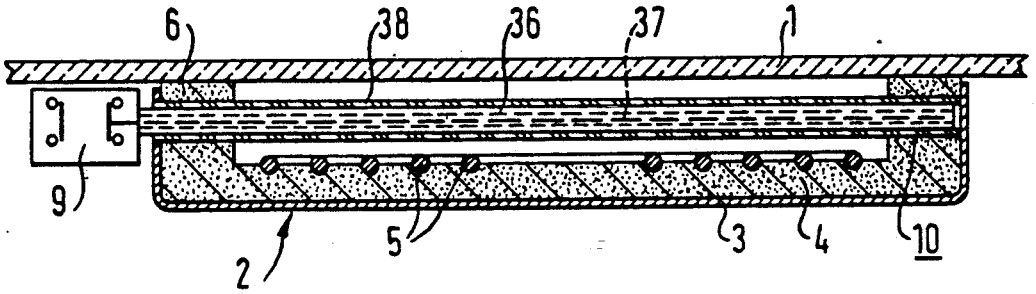
FIG. 20 is a fragmentary, longitudinal-sectional view of the configuration of FIG. 19.
Figure 19:
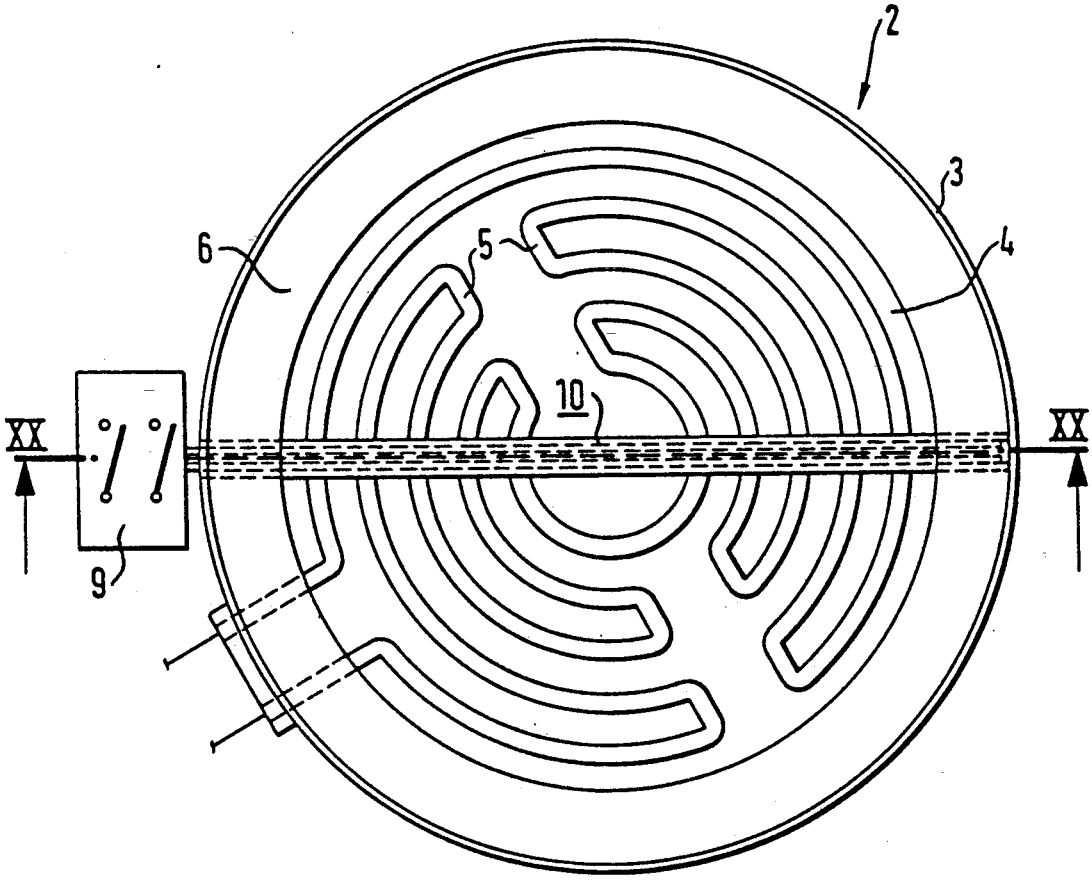
FIG. 19 is a top-plan view of a seventh exemplary embodiment of a glass-ceramic cooktop, with the light device disposed in a sensor of a safety temperature limiter.

In the exemplary embodiment of FIGS. 17 and 18, a respective fiber optical wave guide 30 or 30' is provided as the signal device. The wave guide extends radially from the outside of the burner region to the center thereof. In a first variant, the fiber optical wave guide 30 is disposed above the heating windings or coils 5 of the radiant heating element 2, directly below the surface 1. The wave guide 30 has an opening 31 formed therein outside the jacket 3 of the radiant heating element 2, for the introduction of a light source in the form of a bulb 32, and it has an enlarged circular light surface 33 at its center, which is provided with reflective rippling corresponding to FIG. 7. In the course of the fiber optical wave guide 30, there are also a plurality of successive reflection notches or reflection recesses 34. As FIG. 18 shows, this fiber optical wave guide 30 is located in an at least predominantly unheated region above the heating coils 5, namely at the point where the heating coils reverse. Once again, the bulb 32 is electrically connected to the safety temperature limiter 9. Alternatively, the fiber optical wave guide 30' may also be provided under the radiant heating element 2, and it may likewise be connected to a bulb and extend as far as the center of the burner region. At that point, the cup-shaped jacket 3 has an opening 35 formed therein in the form of a duct, through which the luminous area again formed in the center can be visually seen from above the surface, if the residual-heat indicator indicates excess temperature.

In the exemplary embodiments of FIGS. 19–24, the light device of the residual-heat indicator is structurally connected with the sensor 10 of the safety temperature limiter 9. The sensor 10 extends radially across the burner region of the glass-ceramic surface 1. As can be seen from FIG. 20, the sensor 10 of the safety temperature limiter 9 is formed of a glass tube 36 with an expansion bar 37 which is located therein in a known manner and senses the temperature of the glass-ceramic surface 1 in order to protect it. If objectionable temperatures are attained, it dictates appropriate switching provisions in the safety temperature limiter 9. The sensor 10 is surrounded by a further transparent protective glass tube 38. As FIG. 21 shows, a light device in the form of an elongated incandescent wire or strip 39 is disposed in a hollow space between the two glass tubes 36 and 38, for instance by being wrapped on the outside of the inner glass tube 36. Preferably, this incandescent wire or incandescent strip 39 is larger in cross section on the side toward the surface 1 than under the glass tube 36 in the region of the return line of the electric conductor. As is shown in FIG. 22, the incandescent wire 39 may also be wound onto the surface of the inner glass tube 36. This incandescent wire is in turn electrically connected to contacts of the safety temperature limiter.

In the exemplary embodiment of FIGS. 23 and 24, a strip-like fiber optical wave guide 40 is disposed above and parallel to the sensor 10 of the safety temperature limiter 9 and is, for instance, suitably mechanically coupled to the sensor 10. Once again, this fiber optical wave guide has light-reflecting ripples or the like identified by reference numeral 41 along its length, and it is once again optically connected to safety temperature limiter 9.

We claim:

1. A cooktop, comprising an at least partially transparent surface being formed of glass or glass ceramic and having burner regions with peripheral and inner portions, heating elements disposed beneath said surface in the vicinity of said burner regions, and a lighting apparatus for visually indicating heating of said surface exceeding a predetermined temperature at which said surface is permitted to be touched, said lighting apparatus having a temperature-dependent switch thermally coupled to said surface and light devices controlled by said switch, each of said light devices being in the form of an elongated electric bulb disposed in one of said portions of a respective one of said burner regions.

2. The cooktop according to claim 1, wherein said elongated electric bulb annularly outlines a respective burner region.

3. The cooktop according to claim 2, wherein said elongated electric bulb is formed of spaced-apart successive dot or dash-shaped luminous fields.

4. A cooktop, comprising an at least partially transparent surface being formed of glass or glass ceramic and having burner regions with peripheral and inner portions, heating elements disposed beneath said surface in the vicinity of said burner regions, and a lighting apparatus for visually indicating heating of said surface exceeding a predetermined temperature at which said surface is permitted to be touched, said lighting apparatus having a temperature-dependent switch thermally coupled to said surface and light devices controlled by said switch, each of said light devices being in the form of an elongated incandescent wire being disposed in a transparent protective tube and connected to a current source and being disposed in one of said portions of a respective one of said burner regions.

5. The cooktop according to claim 4, wherein said elongated incandescent wire annularly outlines a respective burner region.

6. The cooktop according to claim 4, wherein said elongated incandescent wire is formed of spaced-apart successive dot or dash-shaped luminous fields.

7. A cooktop comprising an at least partially transparent surface being formed of glass or glass ceramic and having burner regions with peripheral and inner portions, heating elements disposed beneath said surface in the vicinity of said burner regions, and a lighting apparatus for visually indicating heating of said surface exceeding a predetermined temperature at which said surface is permitted to be touched, said lighting apparatus having a temperature-dependent switch thermally coupled to said surface and light devices controlled by said switch, each of said light devices being in the form of a coiled incandescent wire disposed in a transparent protective tube and connected to a current source and being disposed in one of said portions of a respective one of said burner regions.

8. The cooktop according to claim 7, wherein said coiled incandescent wire annularly outlines a respective burner region.

* * * * *